US010767241B2

(12) United States Patent
Polo et al.

(10) Patent No.: US 10,767,241 B2
(45) Date of Patent: Sep. 8, 2020

(54) SUPPORT FIXTURE FOR HEAT TREATING SHEETS HAVING COMPLEX SHAPES

(71) Applicants: Michael G. Polo, Wethersfield, CT (US); Anthony M. Cacace, Haddam, CT (US); Carl M. Johnson, Manchester, CT (US)

(72) Inventors: Michael G. Polo, Wethersfield, CT (US); Anthony M. Cacace, Haddam, CT (US); Carl M. Johnson, Manchester, CT (US)

( * ) Notice: Subject to any disclaimer, the term of this patent is extended or adjusted under 35 U.S.C. 154(b) by 434 days.

(21) Appl. No.: 15/372,989

(22) Filed: Dec. 8, 2016

(65) Prior Publication Data

US 2017/0183749 A1 Jun. 29, 2017

Related U.S. Application Data

(60) Provisional application No. 62/264,615, filed on Dec. 8, 2015.

(51) Int. Cl.
*C21D 9/00* (2006.01)

(52) U.S. Cl.
CPC ..... *C21D 9/0025* (2013.01)

(58) Field of Classification Search
CPC ..... C21D 9/0025
(Continued)

(56) References Cited

U.S. PATENT DOCUMENTS 3,238,034 A * 3/1966 Jendrisak ..... C03B 23/027 65/290
3,717,449 A * 2/1973 Seymour ..... C03B 23/031 65/104

(Continued)

FOREIGN PATENT DOCUMENTS

DE 102011120725 A1 6/2012
EP 2633942 A2 9/2013

OTHER PUBLICATIONS

Non-Final Office Action issued in U.S. Appl. No. 15/075,795, dated Dec. 4, 2018.

(Continued)

*Primary Examiner* — Grant Moubry
*Assistant Examiner* — John E Bargero
(74) *Attorney, Agent, or Firm* — MKG, LLC

(57) ABSTRACT

A fixture is provided for holding sheets having complex shapes during heat treating. The fixture includes a base having a central opening and defining a peripheral foundation. A support structure extends inwardly and upwardly from the base and across the central opening. The support structure includes first axial and traverse openings extending there through. A sheet engagement structure is secured to the support structure and includes second axial openings extending there through. The sheet engagement structure has a peripheral section and at least one connecting leg extending between portions of the peripheral section. A sheet securing ring is removably secured to the sheet engagement structure for slidingly securing a sheet between the sheet securing ring and the sheet engagement structure. The central opening, first axial and traverse openings and second axial openings cooperating to create a uniform and accelerated flow of fluid through the fixture.

18 Claims, 24 Drawing Sheets

(58) Field of Classification Search
USPC ..... 432/261
See application file for complete search history.

(56) References Cited

U.S. PATENT DOCUMENTS

| | | | | |
|---|---|---|---|---|
| 3,915,742 | A * | 10/1975 | Battles | H01M 2/14 429/102 |
| 4,812,157 | A * | 3/1989 | Smith | C03B 23/0252 65/273 |
| 6,463,779 | B1 | 10/2002 | Terziakin | |
| 6,578,385 | B1 * | 6/2003 | Tamai | C03B 27/0445 65/348 |
| 7,284,402 | B2 | 10/2007 | Friedman et al. | |
| 8,845,945 | B2 | 9/2014 | Parkin | |
| 2002/0062941 | A1 | 5/2002 | Cowie et al. | |
| 2012/0111078 | A1 | 5/2012 | Morales | |
| 2013/0195674 | A1 | 8/2013 | Watson et al. | |
| 2013/0252191 | A1 * | 9/2013 | Guichard | C21D 9/0025 432/253 |
| 2014/0202345 | A1 | 7/2014 | Wood | |
| 2015/0013144 | A1 | 1/2015 | Bush et al. | |
| 2016/0108505 | A1 | 4/2016 | Fujii et al. | |
| 2019/0323773 | A1 * | 10/2019 | Crafton | F27D 5/0006 |

OTHER PUBLICATIONS

European Search Report issued in European Patent Application No. 17162173.3, dated Nov. 27, 2017.

Altan, et al. "Cold and Hot Forging—Fundamentals and Applications"; ASM International; 2004.

* cited by examiner

SUPPORT FIXTURE FOR HEAT TREATING SHEETS HAVING COMPLEX SHAPES

CROSS-REFERENCE TO RELATED APPLICATION

This application claims the benefit, in accordance with 35 U.S.C. § 119(e), of U.S. Provisional Patent Application Ser. No. 62/264,615; filed on Dec. 8, 2015, which is incorporated herein by reference in its entirety.

TECHNICAL FIELD

The present invention is directed to support fixtures for holding sheets having complex three dimensional shapes during heat treatment of the sheets, and more particularly for fixtures having flow channels for facilitating uniform and accelerated heating and cooling of the sheets and mitigating thermally induced distortion of the sheets.

BACKGROUND

Sheets having a complex shape have numerous uses in many fields. For example, turbines (such as those of, e.g., a jet engine) generally employ one or more such sheets for various purposes, e.g., to generate thrust. It is required of sheets having a complex shape that the sheets be manufactured precisely, accurately, and with uniformity, at least in order to ensure predictability in the sheet's application. However, due to practical aspects intrinsic in manufacturing processes of the prior art, it is difficult to manufacture sheets having complex shapes with the requisite precision, accuracy, and uniformity.

In addition, such sheets are typically heat treated and quenched to impart predetermined properties. However, sheets having the complex shapes tend to warp and distort during heating and quenching. Some fixtures used to hold the sheets during heat treatment and quenching do not eliminate the warping and distortion and can worsen it.

There is an unfulfilled need for fixtures for holding sheets having complex shapes during heat treating.

SUMMARY OF THE INVENTION

In one aspect, the present invention is directed to a fixture for holding sheets having complex shapes during heat treating, the fixture comprising: a base having at least one central opening extending there through, the base defining a peripheral foundation; a support structure extending inwardly and upwardly from the base and across the central opening, the support structure having a plurality of first axial and traverse openings extending there through; a sheet engagement structure secured to the support structure, the sheet engagement structure having a plurality of second axial openings extending there through, the sheet engagement structure having a peripheral section and at least one connecting leg extending between portions of the peripheral section; a sheet securing ring removably secured to the sheet engagement structure for slidingly securing a sheet between the sheet securing ring and the sheet engagement structure; and the at least one central opening, plurality of first axial and traverse openings and the plurality of second axial openings cooperating to create a uniform and accelerated flow of fluid through the fixture.

In another aspect, the present invention is directed to a fixture for holding sheets having complex shapes during heat treating, the fixture comprising: a base having at least one central opening extending there through, the base defining a peripheral foundation; a support structure extending inwardly and upwardly from the base and across the central opening, the support structure having a plurality of first axial and traverse openings extending there through; a sheet engagement structure secured to the support structure, the sheet engagement structure having a peripheral section and a second axial opening extending there through; a gap defined between the peripheral section and the sheet engagement structure; a first plurality of tabs extending from the sheet engagement structure configured to engage one or more edge mounted tabs formed on the sheets; and the at least one central opening, plurality of first axial and traverse openings and the second axial opening cooperating to create a uniform and accelerated flow through the fixture.

DETAILED DESCRIPTION

Figure 1:
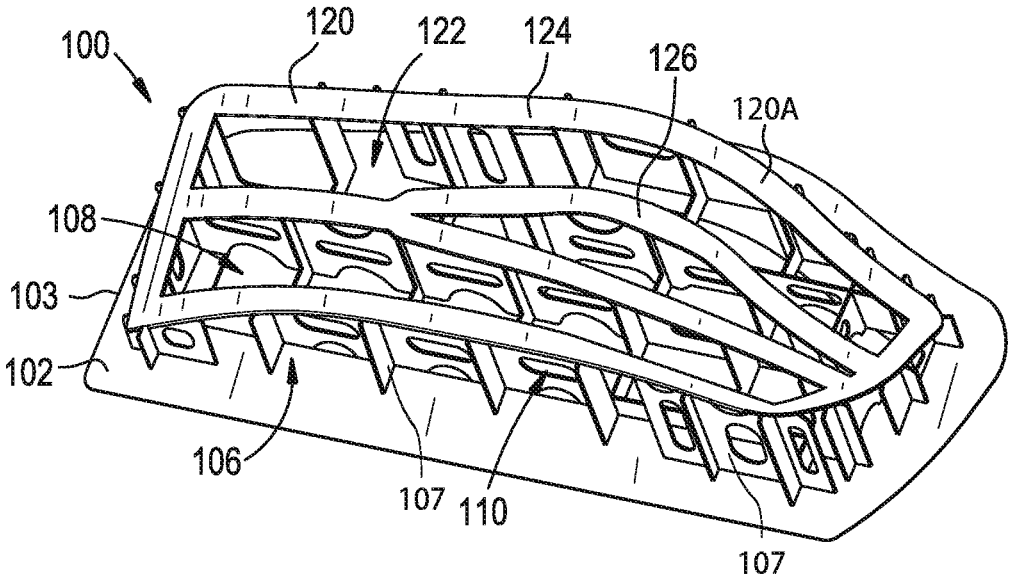
FIG. 1 is a perspective view of a heat-treating fixture of the present invention used for heating and quenching of sheets having complex shapes.
Figure 2:
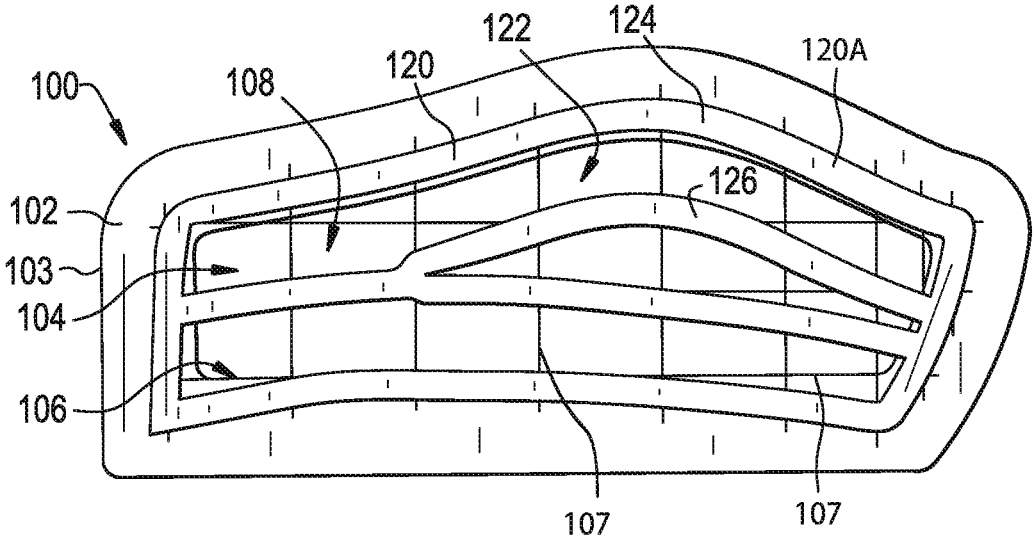
FIG. 2 is a top view of the heat treating fixture of FIG. 1.
Figure 3:
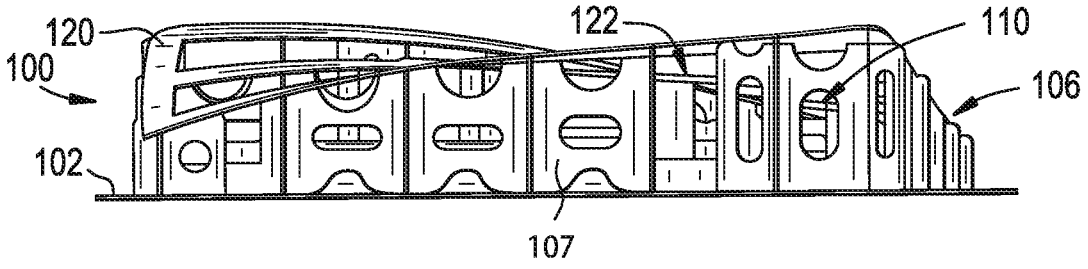
FIG. 3 is a front view of the heat treating fixture of FIG. 1.
Figure 4:
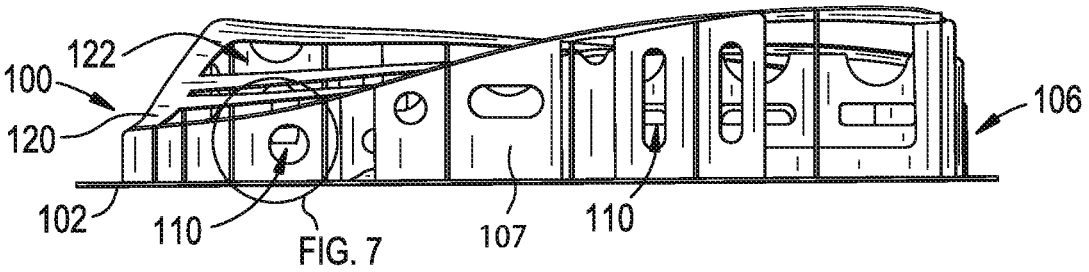
FIG. 4 is a back view of the heat treating fixture of FIG. 1.
Figure 5:
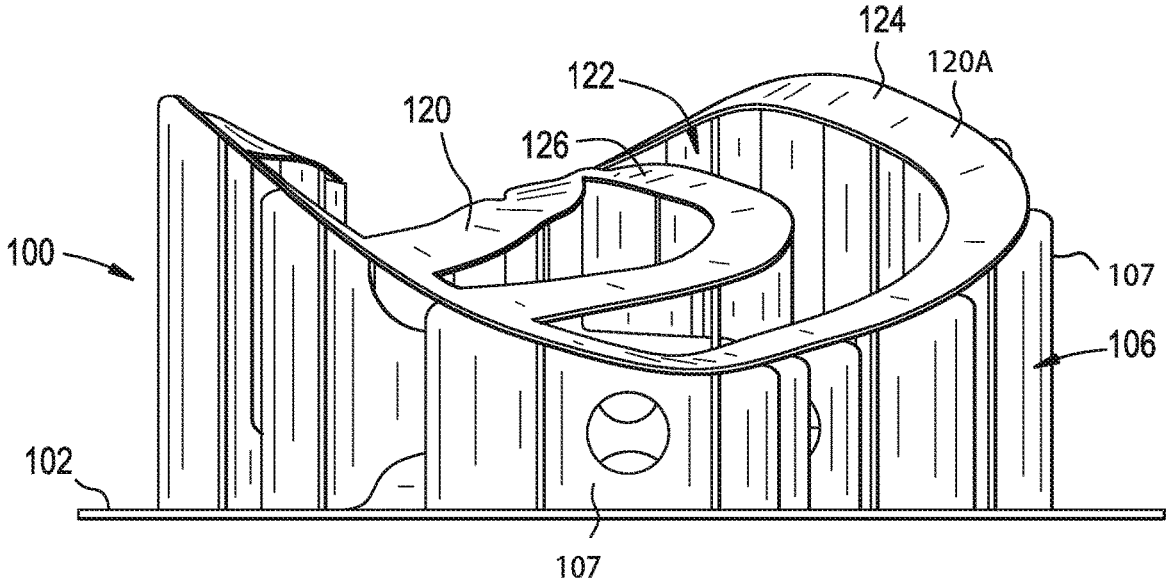
FIG. 5 is a right side view of the heat treating fixture of FIG. 1.
Figure 6:
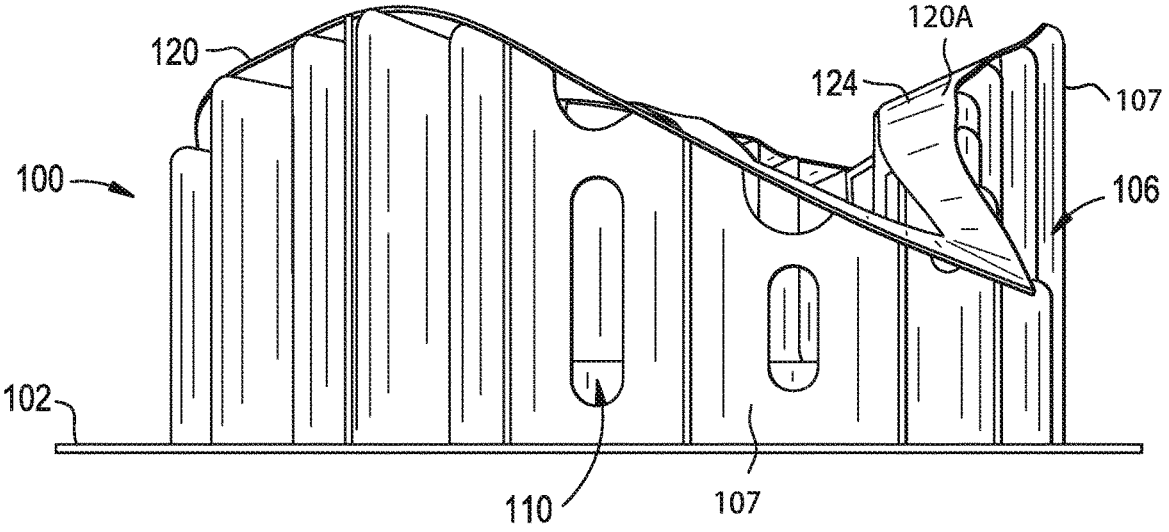
FIG. 6 is a left side view of the heat-treating fixture of FIG. 1.
Figure 7:
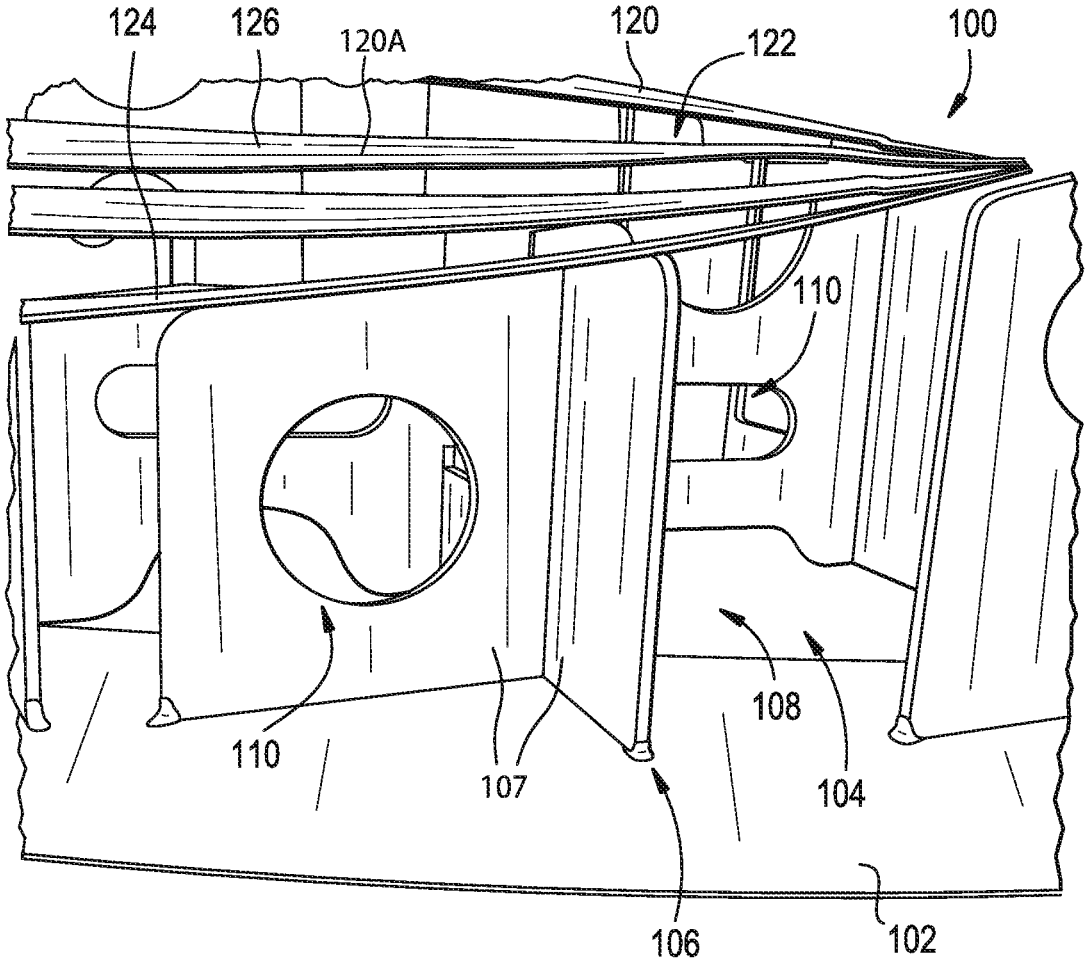
FIG. 7 is a detail view of a portion of the heat-treating fixture of FIG. 4.

A fixture 100 in accordance with the present invention is configured for holding one or more sheets having complex three-dimensional shapes, such as for example, a sheet having a predetermined shape as being produced by a hot-forming process. In one embodiment, the fixture 100 holds the sheet during one or more heat treating processes, such as for example heating up to about 1000 degrees Fahrenheit and quenching to 70 to 90 degrees Fahrenheit. In one embodiment, the fixture 100 is configured to hold one sheet having a complex three-dimensional shape. In one embodiment, the fixture 100 is configured to hold a plurality of production sheets wherein each sheet has the same complex three-dimensional shape.

As shown in FIGS. 1-7, one embodiment of the fixture 100 includes a base 102 having at least one central opening 104 extending there through. The base 102 defines a peripheral foundation 103. A support structure 106 having walls 107 extending inwardly and upwardly from the base and across the central opening 104. The support structure 106 has a plurality of first axial openings 108 and traverse openings 110 extending there through. The fixture 100 includes a sheet engagement structure 120 secured to the support structure 106.

The sheet engagement structure 120, having an upper engagement surface 120A, is configured to conform to the complex three-dimensional shape of the sheet. The sheet engagement structure 120 has a plurality of second axial openings 122 extending there through. The sheet engagement structure 120 has a peripheral section 124 and at least one connecting leg 126 extending between portions of the peripheral section 124. The central opening 104, the plurality of first axial openings 108, the traverse openings 110 and the plurality of second axial openings 122 cooperate to create a uniform and accelerated flow of fluid through the fixture 100, for example an atmosphere in a furnace during heating or a cooling medium such as glycol (e.g., 37 to 40 percent concentration) during quenching.

Figure 10:
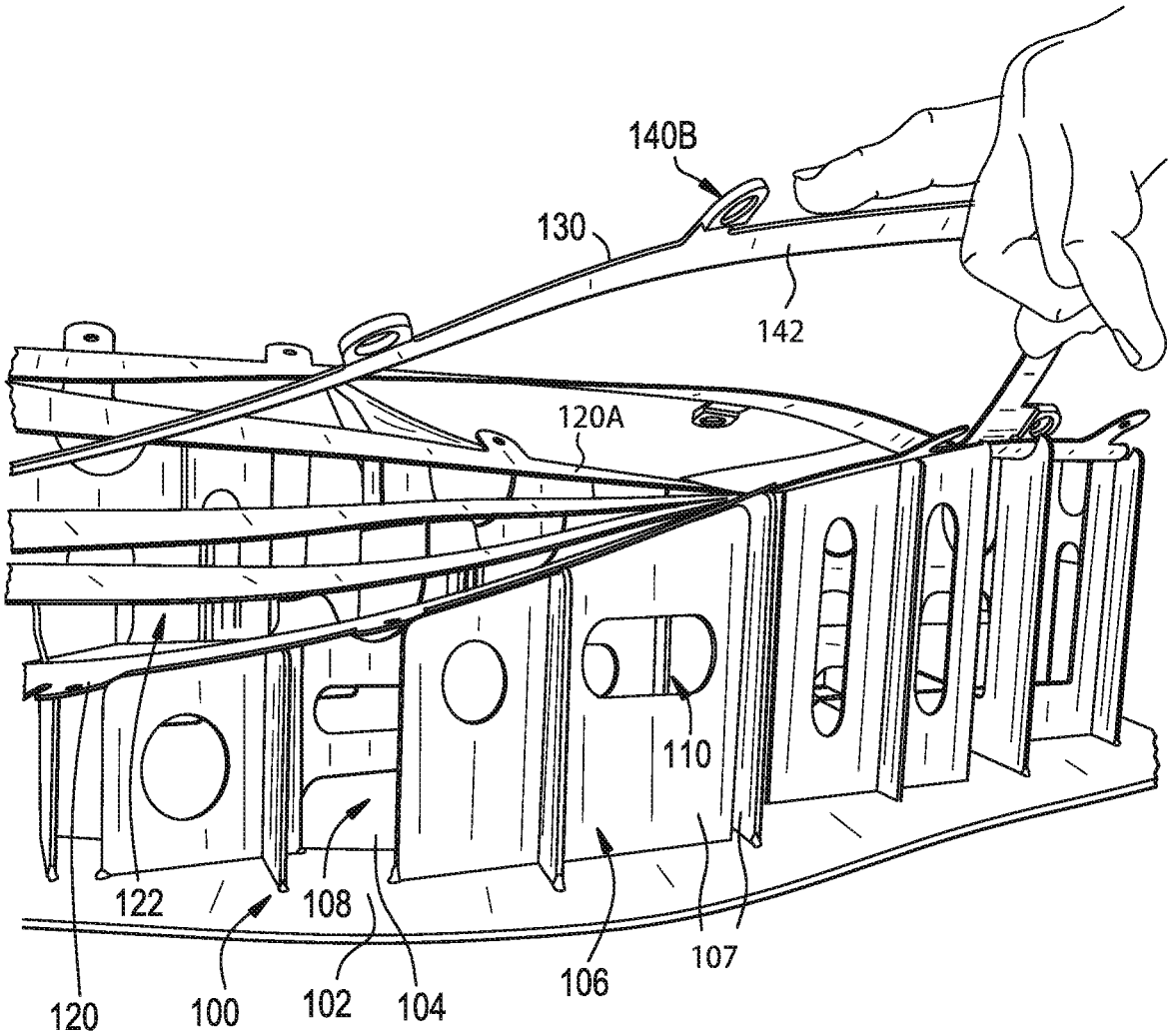
FIG. 10 is a front view of the heat-treating fixture of FIG. 1 and a sheet securing ring with spacers attached thereto.
Figure 11:
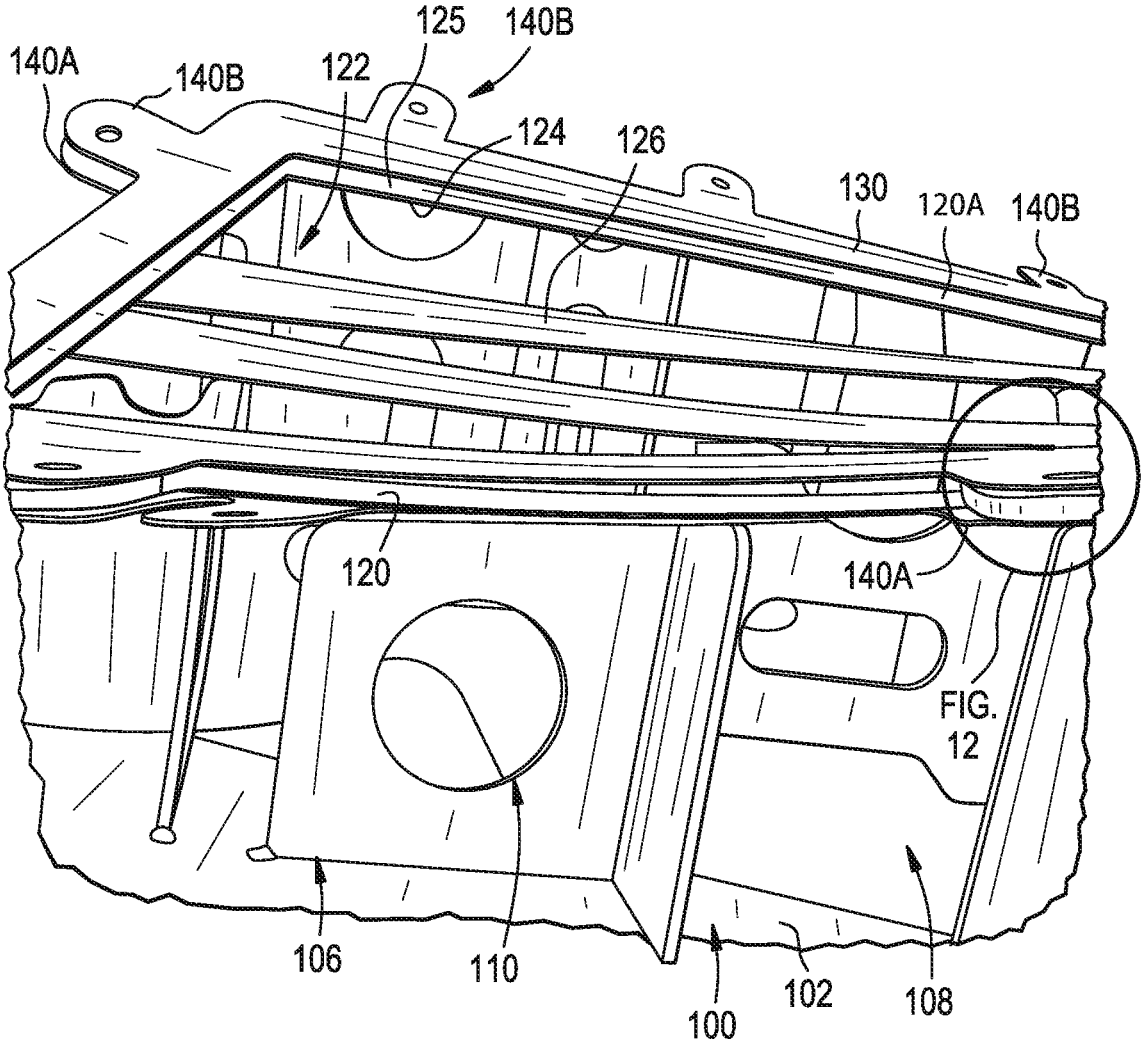
FIG. 11 is a front view of the heat-treating fixture of FIG. 10 where the sheet securing ring with spacers is attached to the heat-treating fixture.
Figure 12A:
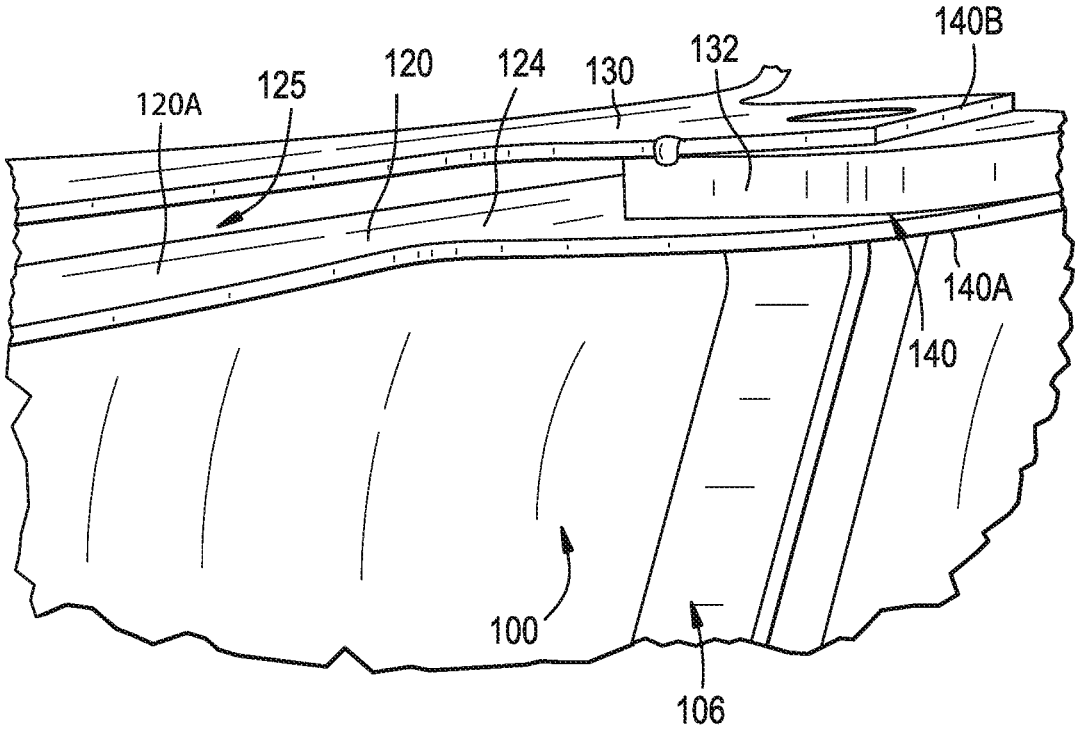
FIG. 12A is a detail view of a portion of the heat-treating fixture of FIG. 11.
Figure 12B:
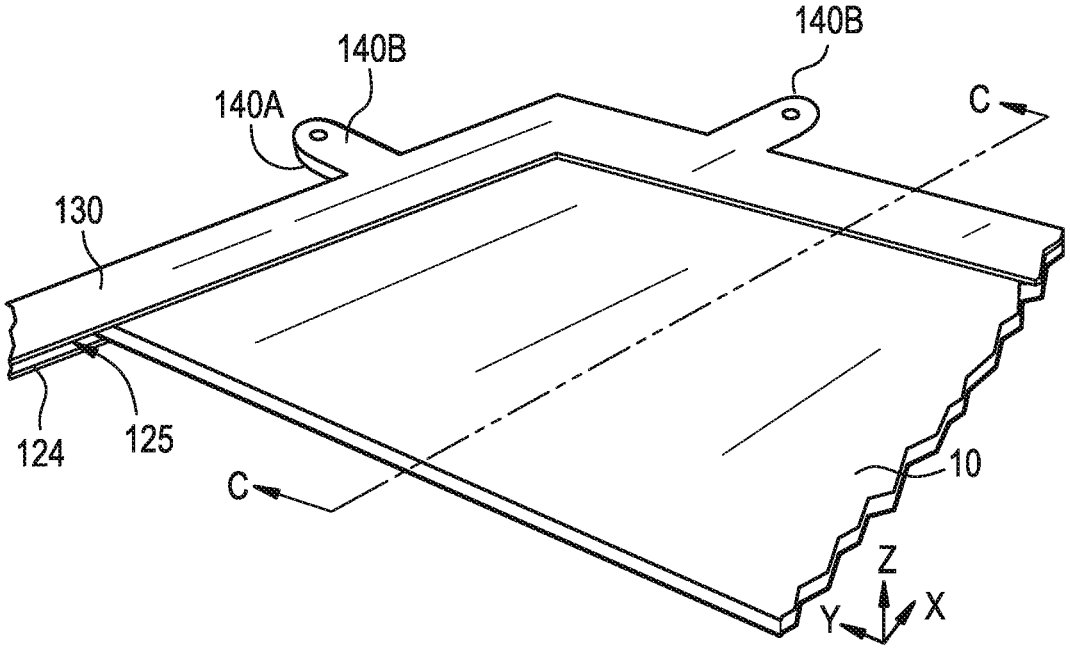
FIG. 12B is detail view of a portion of the heat-treating fixture of FIG. 11 having a sheet positioned therein.
Figure 12C:
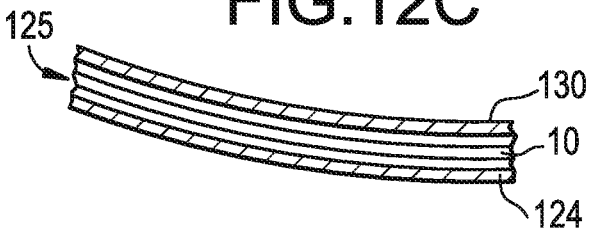
FIG. 12C is a cross-sectional view of the portion of the heat-treating fixture of FIG. 11 having a sheet positioned therein taken along line C-C of FIG. 12B.
Figure 13:
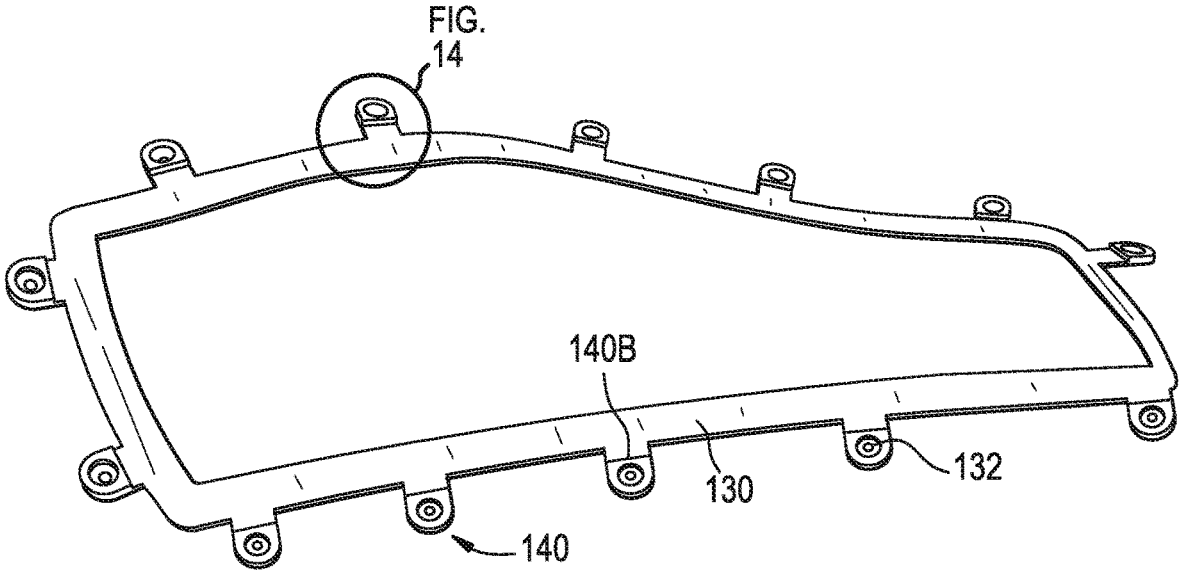
FIG. 13 is a top view of the sheet securing ring and spacers of FIG. 10.
Figure 14:
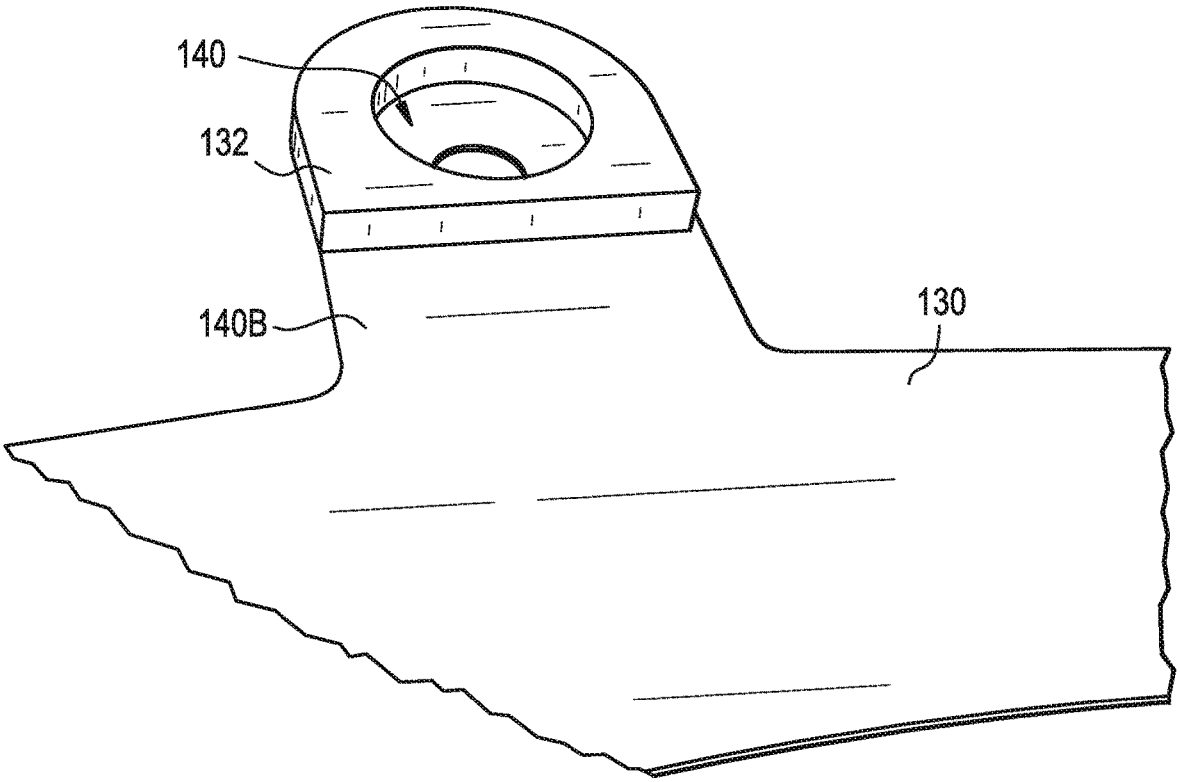
FIG. 14 is a detail view of a portion of the sheet securing ring and spacers of FIG. 13.
Figure 15:
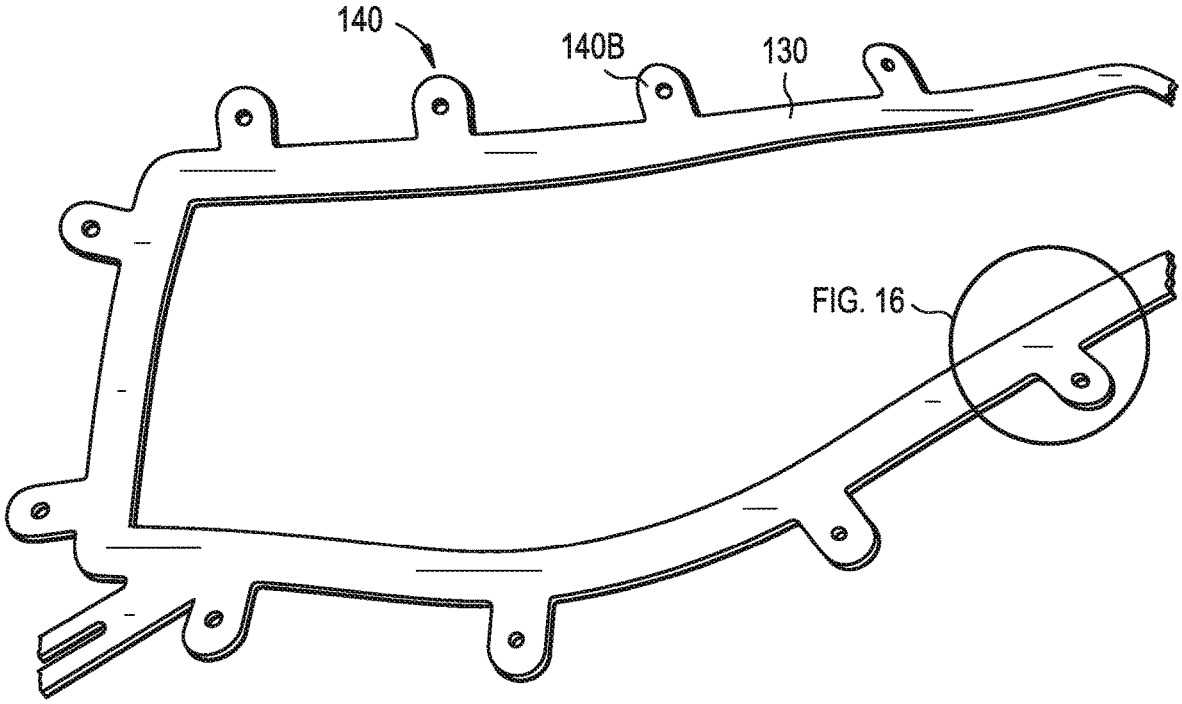
FIG. 15 is a bottom view of the sheet securing ring and spacers of FIG. 10.
Figure 16:
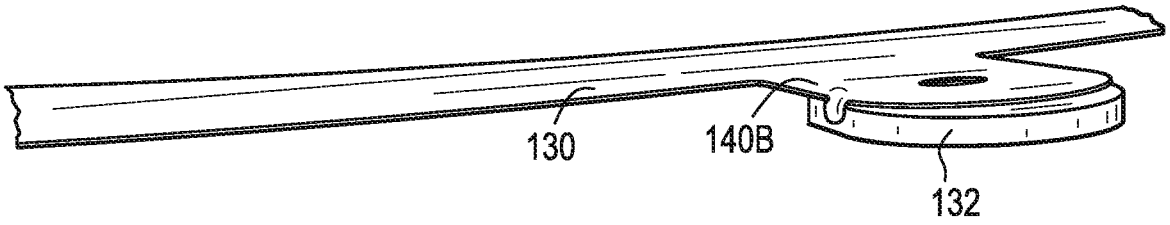
FIG. 16 is a detail view of a portion of the sheet securing ring and spacers of FIG. 15.
Figure 17:
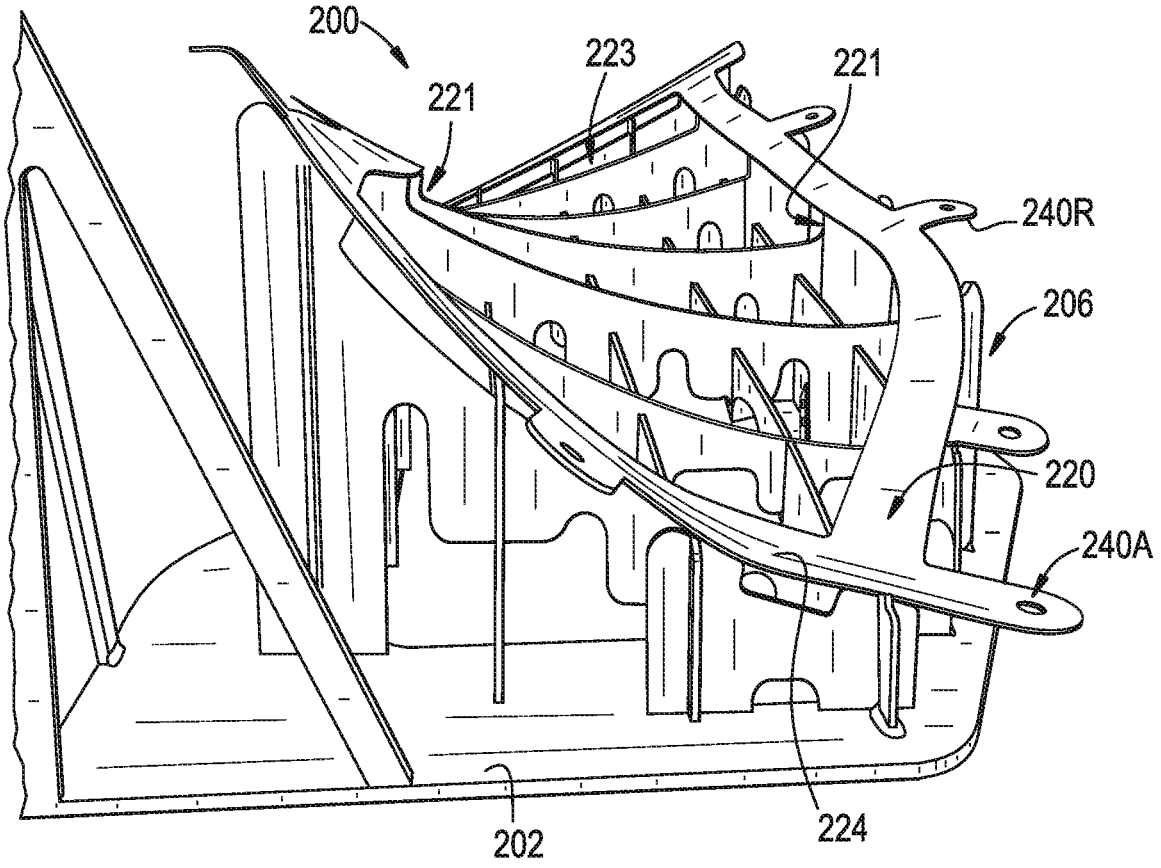
FIG. 17 is a left side view of another heat-treating fixture of the present invention used for holding a stack of sheets for aging of the sheets.
Figure 18:
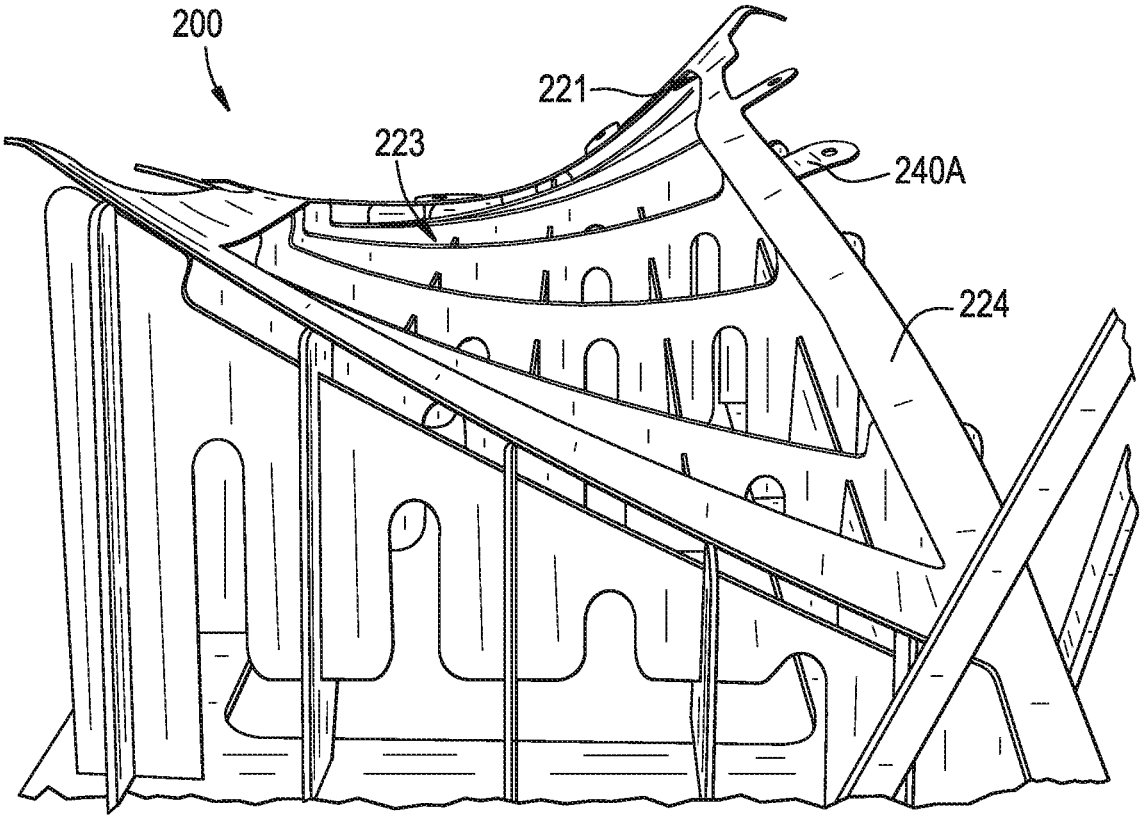
FIG. 18 is a right-side view of the heat-treating fixture of FIG. 17.
Figure 19:
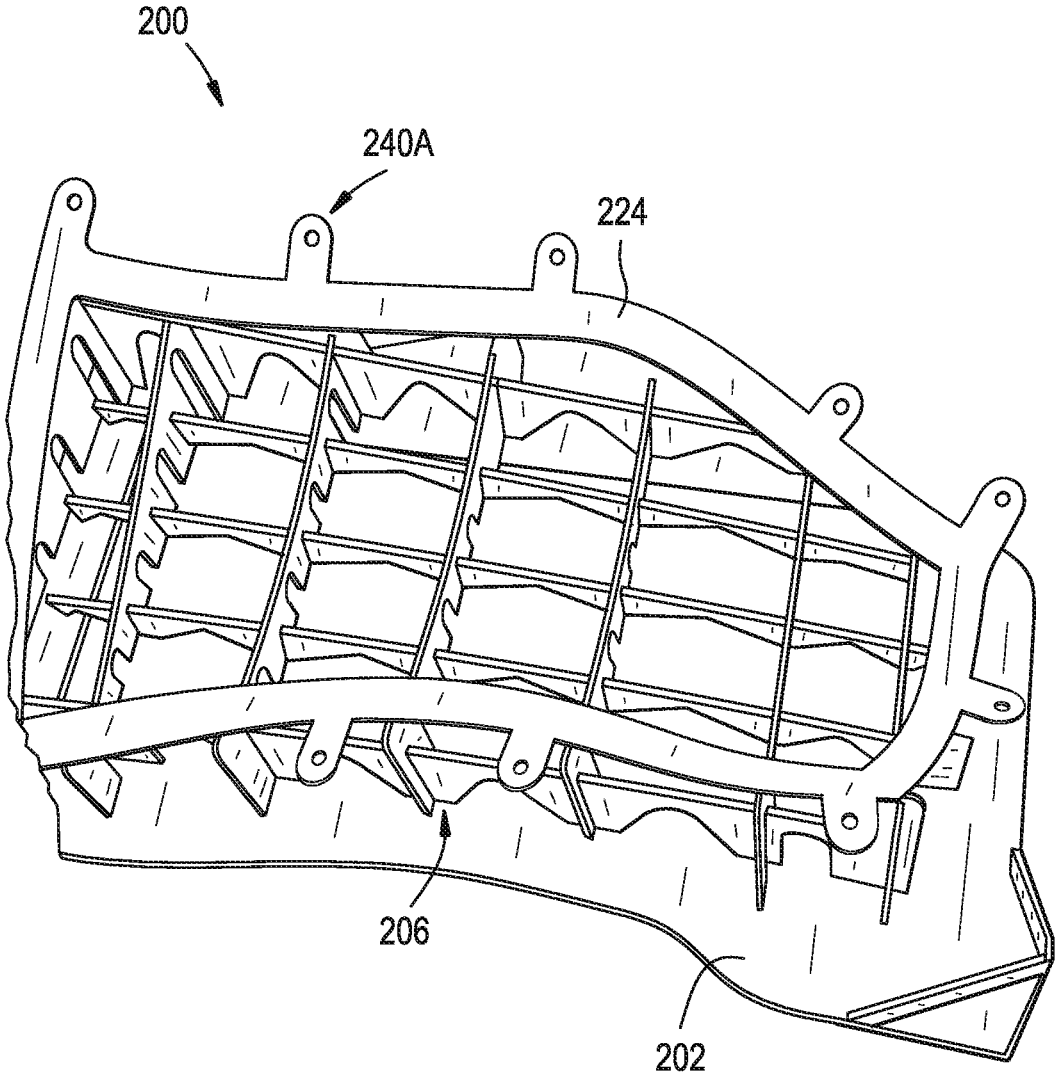
FIG. 19 is a top view of the heat-treating fixture of FIG. 17.
Figure 20:
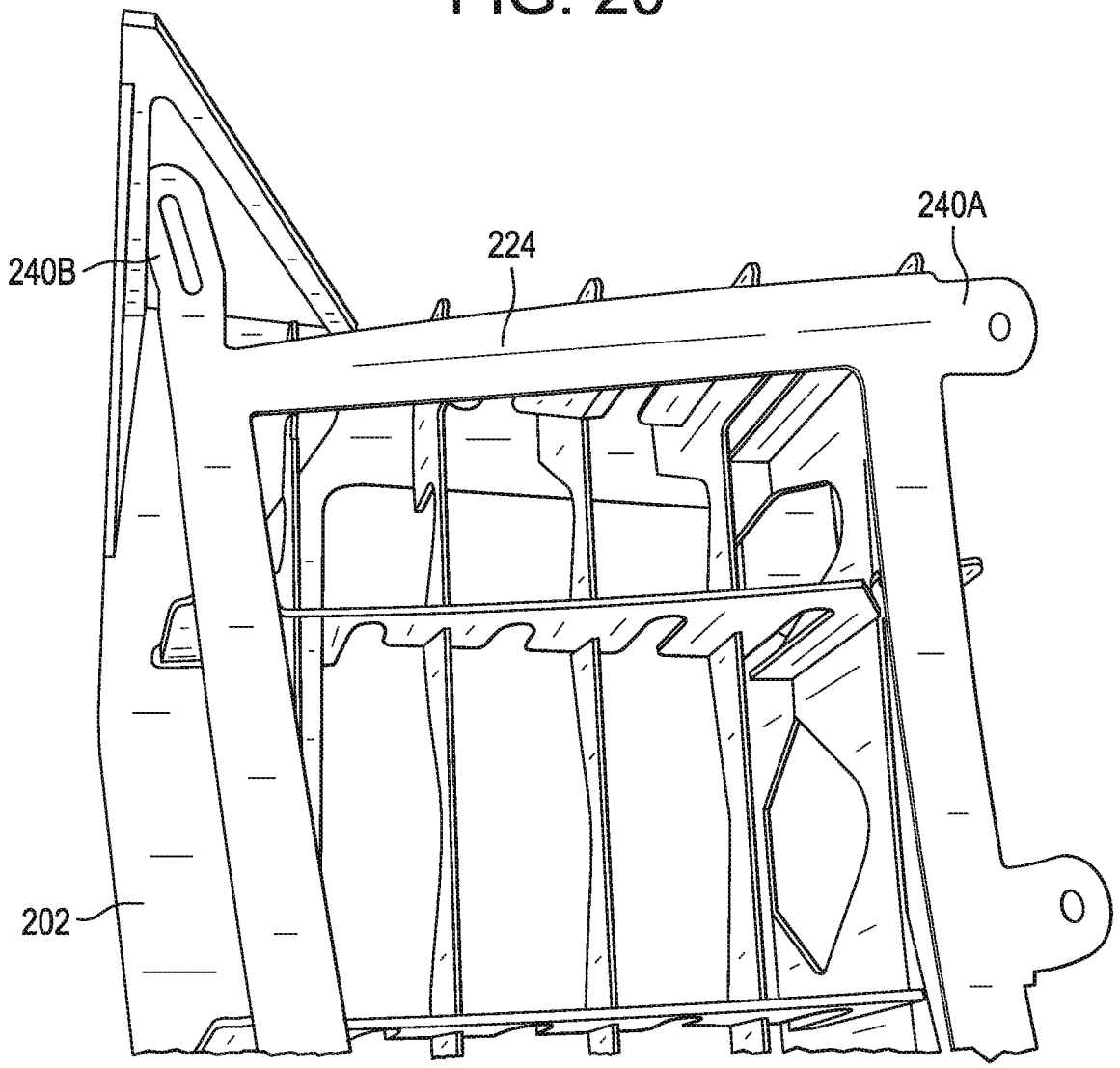
FIG. 20 is a top view of a portion of the heat-treating fixture of FIG. 17.
Figure 21:
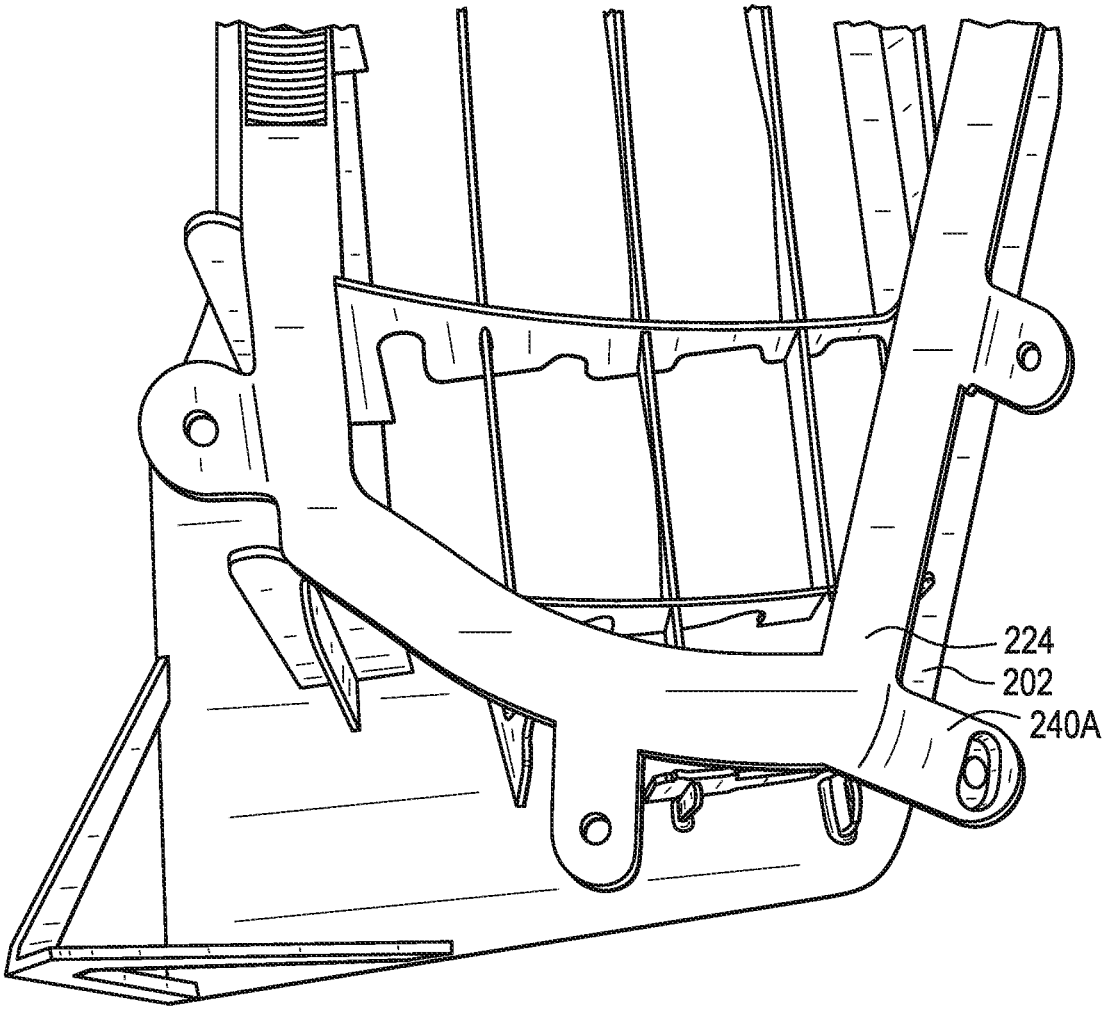
FIG. 21 is a top view of a portion of the heat-treating fixture of FIG. 17.
Figure 22:
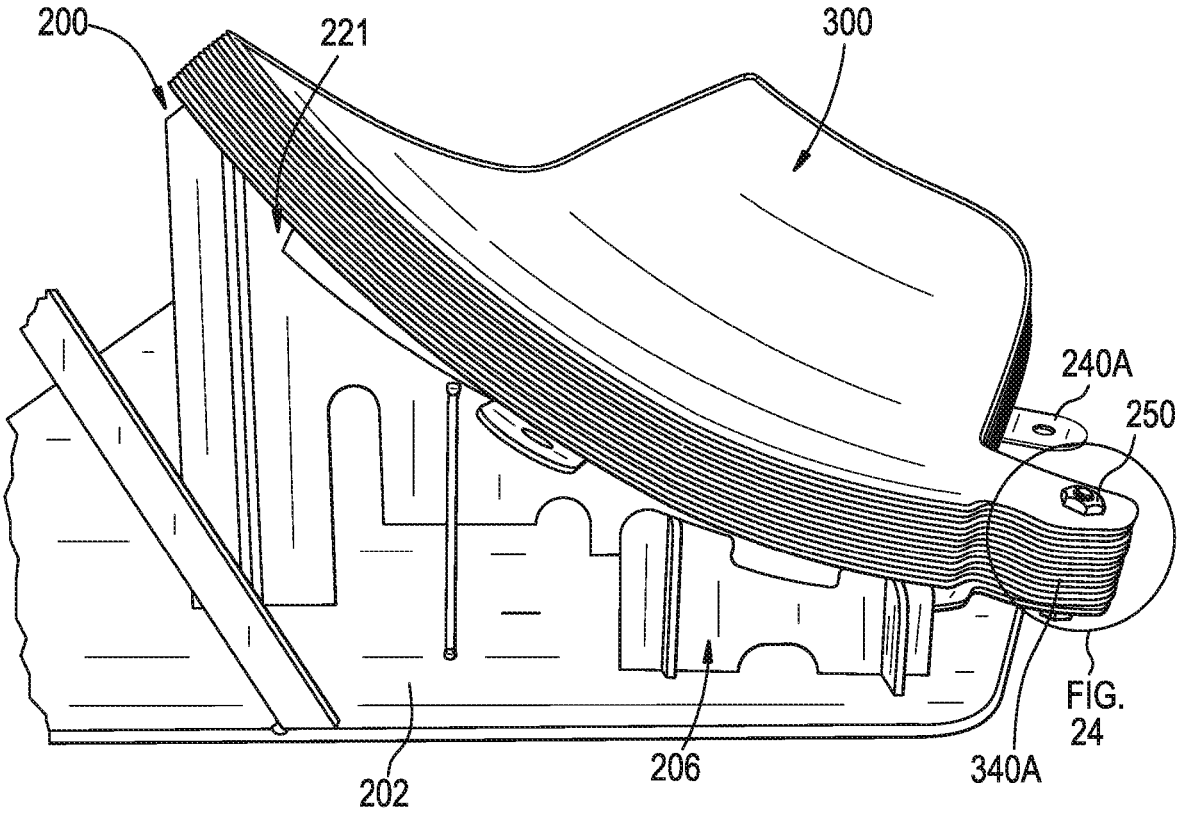
FIG. 22 is a left side view of the heat-treating fixture of FIG. 17 holding a stack of sheets for aging of the sheets.
Figure 23:
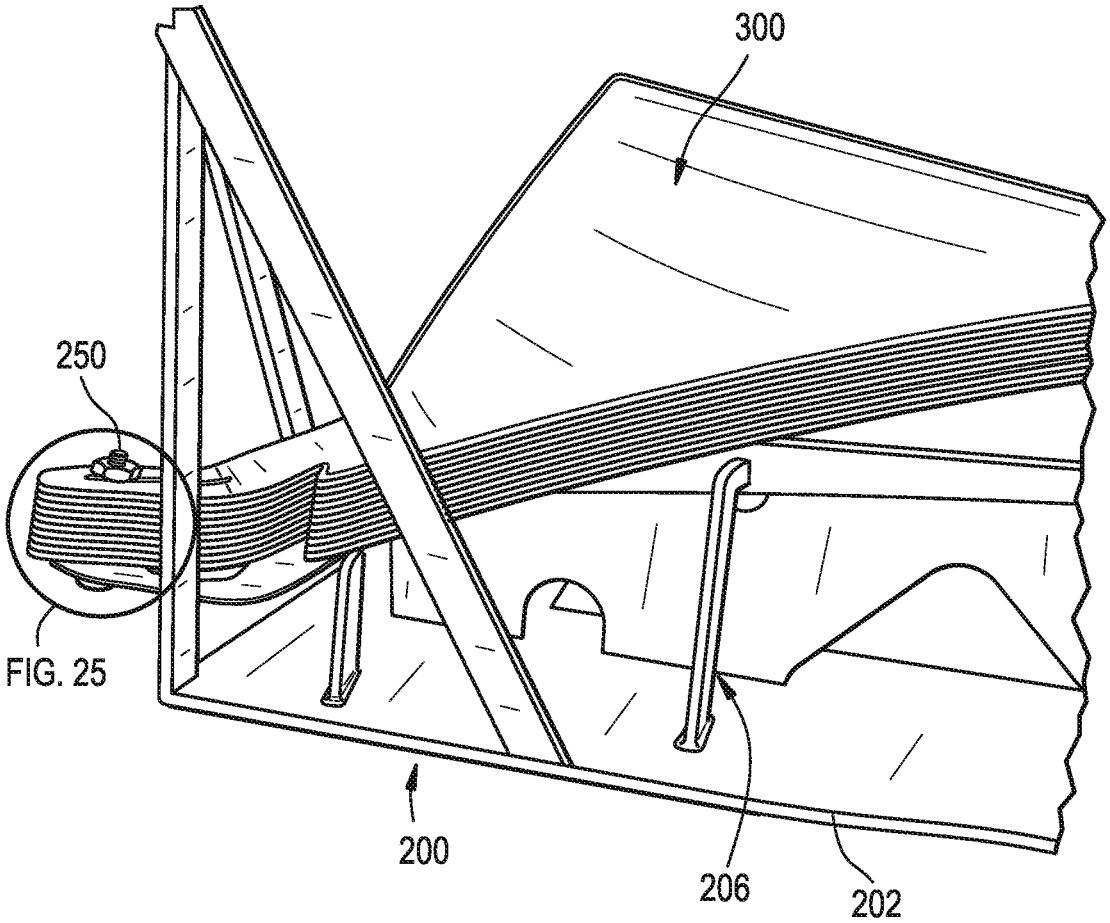
FIG. 23 is a right-side view of the heat-treating fixture of FIG. 22.
Figure 24:
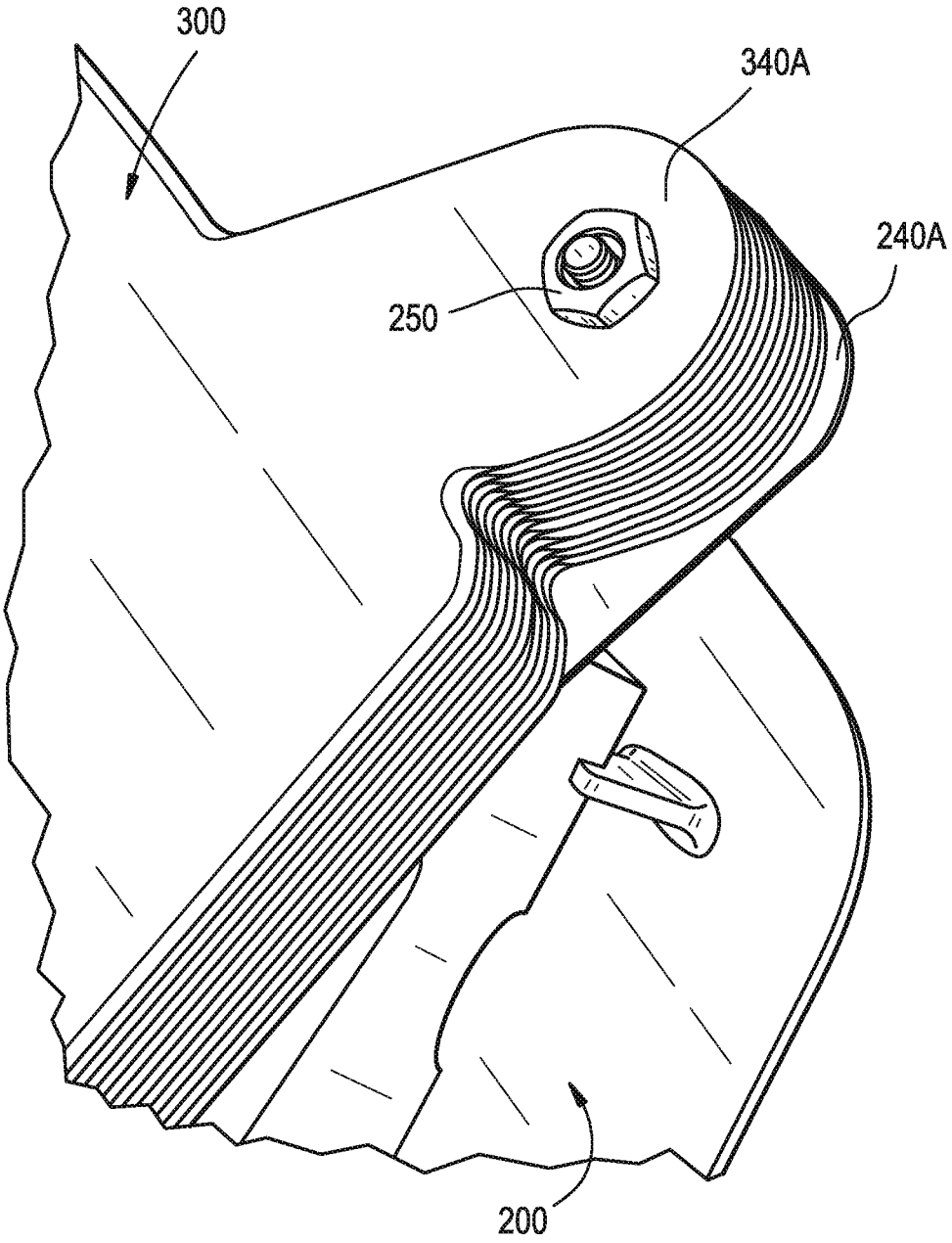
FIG. 24 is a top view of a portion of the heat-treating fixture of FIG. 22.
Figure 25:
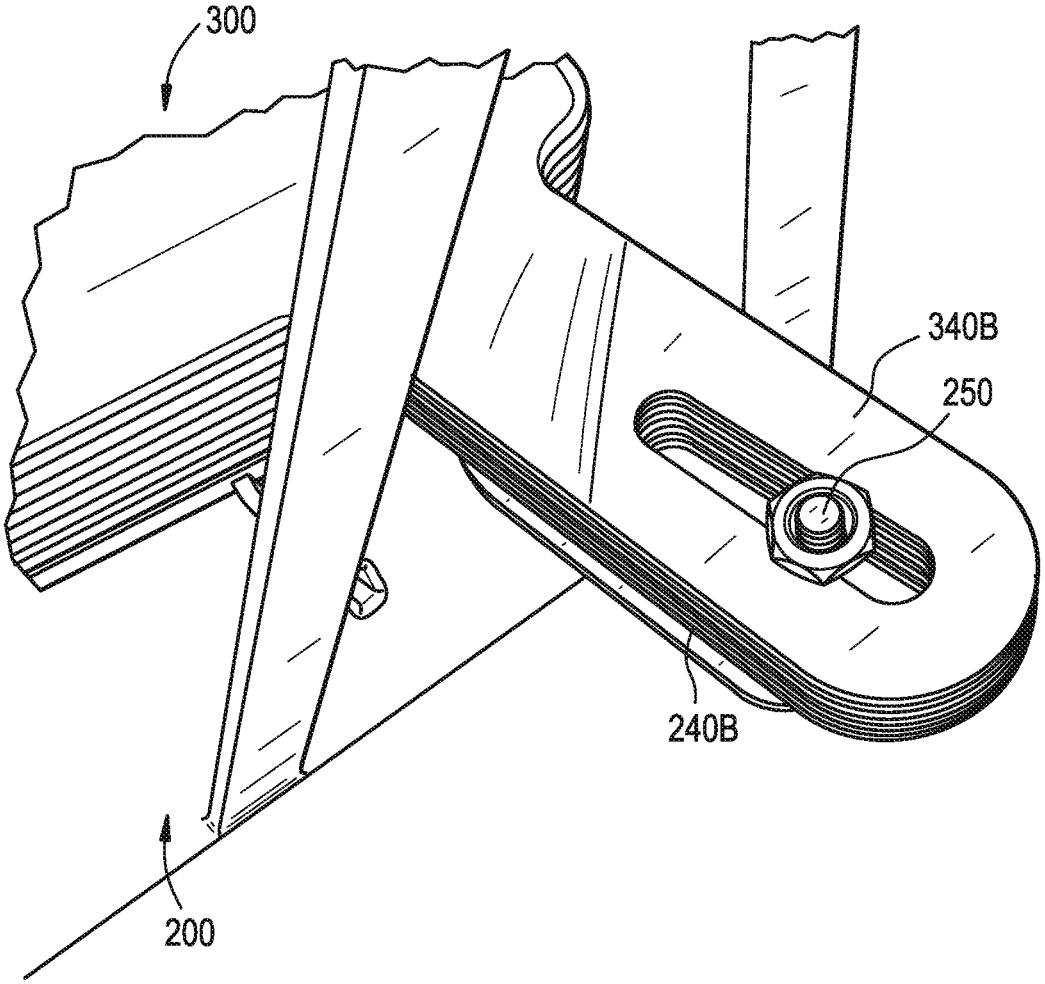
FIG. 25 is a top view of a portion of the heat-treating fixture of FIGS. 23.
Figure 26:
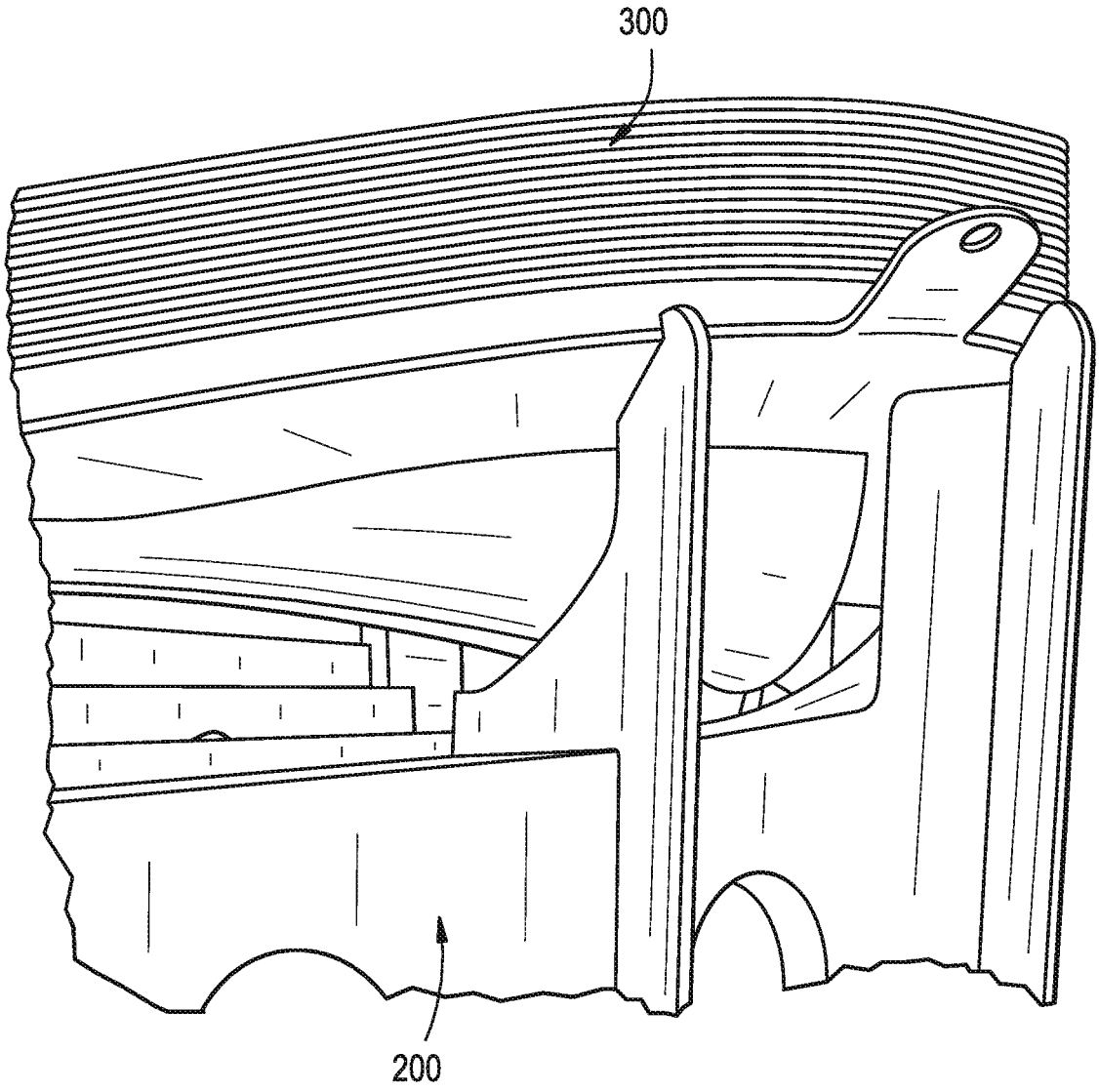
FIG. 26 is a back view of the heat-treating fixture of FIG. 22.

As shown in FIGS. 10 and 11, the fixture 100 includes a sheet securing ring 130 removably secured to the sheet engagement structure 120 for slidingly securing a sheet between the sheet securing ring 130 and the upper engagement surface 120A of the sheet engagement structure 120. In one embodiment, as shown in FIGS. 13-16, the sheet securing section 100 includes a plurality of spacers 132 secured thereto. The spacers 132 are of a predetermined thickness greater than that of the sheet (e.g., greater than 1 mm or 0.04 inches) to allow the sheet to slide between the sheet securing ring 130 and the sheet engagement structure 120 during heating and cooling. In one embodiment, the spacers 132 are secured to the sheet securing ring 130 prior to attaching the sheet securing ring 130 to the sheet engagement structure 120.

As shown in FIGS. 11 and 12A-12C, a channel 125 is formed between the peripheral section 124 of the sheet engagement structure 120 and the sheet securing ring 130. A sheet 10 is positioned within the channel 125 wherein the sheet 10, during a heat-treating process, may expand and/or contract, or float, in one or more of an X direction, a Y direction and a Z direction, resulting from such heat-treating process. As a result, the sheet 10 further conforms to the predetermined shape being produced by the hot-forming process.

Figure 8:
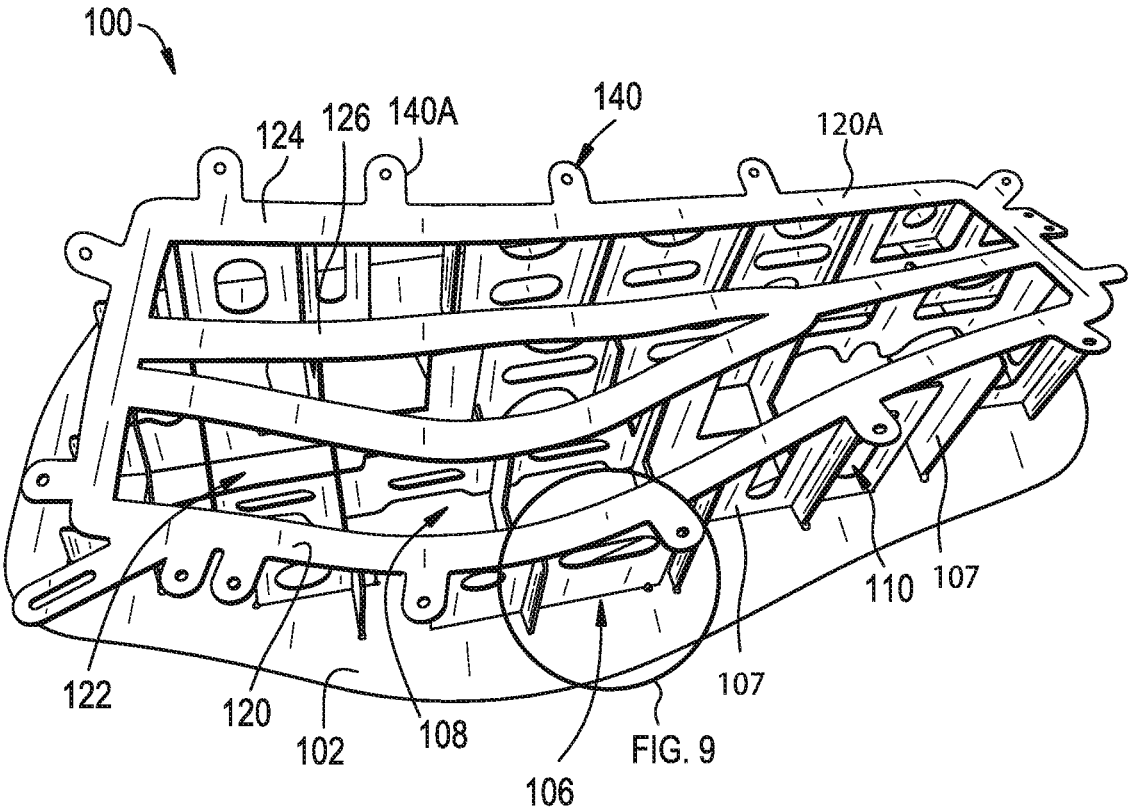
FIG. 8 is a top view of the heat-treating fixture of FIG. 1 wherein a sheet engagement structure includes tabs extending therefrom.
Figure 9:
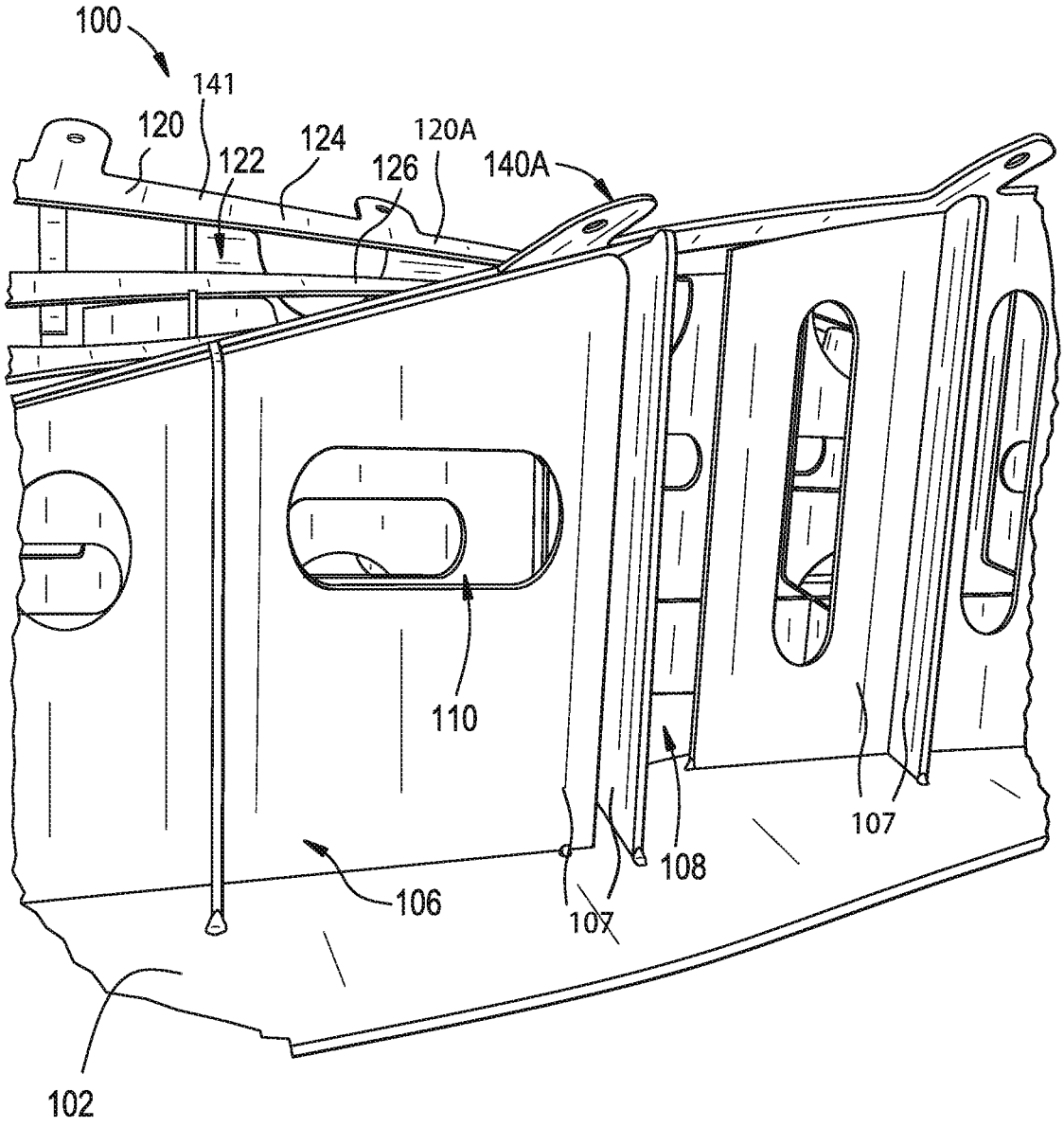
FIG. 9 is a detail view of a portion of the heat-treating fixture of FIG. 8.

In one embodiment, as further shown in FIGS. 8 and 9, the base 102, the support structure 106 and/or the sheet engagement structure 120 has a plurality of tabs 140A extending therefrom for engagement with a corresponding plurality of tabs 140B extending through the sheet securing ring 130 (the plurality of tabs 140A and the plurality of tabs 140B collectively referred to herein as tabs 140). The sheet securing ring 130 and/or the sheet engagement structure 120 has a sliding enhancement coating 141, 142 applied respectively thereto. In one non-limiting embodiment, the sliding enhancement coating 141, 142 is boron nitride.

The base 102, support structure 106, sheet engagement structure 120, the sheet securing ring 130 and the spacers 132 are manufactured from a suitable metal such as but not limited stainless steel. The base 102, support structure 106, sheet engagement structure 120, the sheet securing ring 130 and the spacers 132 are secured to one another via suitable method including but not limited to welding.

As shown in FIGS. 17-21, a fixture 200 in accordance with the present invention is configured for holding a stack of sheets 300 having complex shapes for aging the sheets as shown in FIGS. 22-26. The fixture 200 is similar to the fixture 100 and has a base 202, a support structure 206 and sheet engagement structure 220 having a peripheral section 224, but no connecting legs. Instead, there is a gap 221 between the peripheral section 224 and the sheet engagement structure 220 to allow the sheets 300 to sag as needed.

The sheet engagement structure 220 has a plurality of tabs 240A and/or 240B extending therefrom for engagement with one or more edge mounted tabs 340A and/or 340B integrally formed on the sheets 300. The tabs 240A are secured to the tabs 340B in a suitable number of locations (e.g., two locations shown) with suitable fasteners 250. In one embodiment, the stack includes 5 to 20 sheets.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A fixture for holding one or more sheets having complex shapes during heat-treating processes, the fixture comprising:

a base having at least one central opening extending there through, the base defining a peripheral foundation;

a support structure having walls extending upwardly from the base and traversely across the at least one central opening of the base, the walls defining a plurality of first axial openings and a plurality of traverse openings;

a sheet engagement structure secured to the support structure, the sheet engagement structure having a peripheral section and at least one connecting leg extending between portions of the peripheral section defining a plurality of second axial openings extending through the sheet engagement structure, the peripheral section and the at least one connecting leg of the sheet engagement structure defining an upper engagement surface configured to conform to a surface of the complex shapes of the one or more sheets to support the one or more sheets on the upper engagement surface of the sheet engagement structure; and, a sheet securing ring removably secured to the sheet engagement structure forming a peripheral channel disposed between the peripheral section of the sheet engagement structure and the sheet securing ring for slidingly securing the one or more sheets disposed within the peripheral channel to accommodate expansion, contraction and float of the one or more sheets in one or more of an X direction, a Y direction and a Z direction during a first heat-treating process;

wherein the at least one central opening of the base, the plurality of first axial and traverse openings of the support structure and the plurality of second axial openings of the sheet engagement structure are in fluid communication to create a uniform and accelerated flow of fluid through the fixture during the first heat-treating process.

2. The fixture of claim 1, further comprising a plurality of spacers secured between the sheet securing ring and the sheet engagement structure, the spacers being of a predetermined thickness greater than that of the sheet to allow the sheet to be slidably secured between the sheet securing ring and the upper engagement surface of the sheet engagement structure and within the peripheral channel during heating and cooling.

3. The fixture of claim 1, wherein at least one of the base, the support structure and the sheet engagement structure has a plurality of tabs extending therefrom for engagement with the sheet securing ring.

4. The fixture of claim 1, wherein at least one of the sheet securing ring and the sheet engagement structure has a sliding enhancement coating applied thereto.

5. The fixture of claim 4, wherein the sliding enhancement coating comprises boron nitride.

6. The fixture of claim 1, further comprising:

a first plurality of tabs extending outwardly from the peripheral section of the sheet engagement structure;

a second plurality of tabs extending from the sheet securing ring, the second plurality of tabs configured to engage the first plurality of tabs.

7. The fixture of claim 6, wherein the sheet engagement structure has a sliding enhancement coating applied thereto.

8. The fixture of claim 7, wherein the sliding enhancement coating comprises boron nitride.

9. The fixture of claim 6, further comprising:

a plurality of fasteners extending through the first plurality of tabs, the second plurality of tabs, and a third plurality of tabs extending from the one or more sheets for fixedly securing the one or more sheets to the upper engagement surface of the sheet engagement structure during a second heat-treating process.

10. The fixture of claim 6, further comprising:

a plurality of spacers secured between the first plurality of tabs and the second plurality of tabs, the spacers being of a predetermined thickness greater than that of the sheet to allow the sheet to be slidably secured between the sheet securing ring and the sheet engagement structure and within the peripheral channel during heating and cooling.

11. The fixture of claim 1, wherein the plurality of traverse openings includes at least one opening in a plurality of the walls of the support structure.

12. The fixture of claim 1, wherein the at least one opening in the plurality of walls of the support structure include holes.

13. The fixture of claim 1, wherein the at least one opening in the plurality of walls of the support structure include notches.

14. The fixture of claim 1, wherein at least a portion of at least one wall of the plurality of walls of the support structure is spaced from the base.

15. The fixture of claim 1, wherein at least a portion of at least one wall of the plurality of walls of the support structure is spaced from the sheet engagement structure.

16. The fixture of claim 1, wherein the walls of the support structure form a grid extending over the base.

17. The fixture of claim 1, wherein the at least one connecting leg comprising at least three leg portions extending to different portions of the peripheral sections of the sheet engagement structure.

18. The fixture of claim 1, wherein the sheet engagement structure and the sheet securing ring are configured to slidably secure a plurality of stacked sheets within the peripheral channel.

* * * * *